US005094007A

United States Patent [19]

Gordon

[11] Patent Number: 5,094,007

[45] Date of Patent: Mar. 10, 1992

[54] ADJUSTABLE SIDING GAUGE

[76] Inventor: Daniel Gordon, P.O. Box 121, Bethlehem, N.H. 03574

[21] Appl. No.: 347,655

[22] Filed: Aug. 21, 1989

[51] Int. Cl.[5] ..... G01B 5/14

[52] U.S. Cl. ..... 33/646; 33/647

[58] Field of Search ..... 33/646, 647, 648, 649, 33/411; 269/904

[56] References Cited

U.S. PATENT DOCUMENTS

| | | | |
|---|---|---|---|
| 115,945 | 6/1871 | Fellows | 33/646 |
| 198,772 | 1/1878 | Marsh | 33/646 |
| 396,075 | 1/1889 | Curtis | 33/41 |
| 421,746 | 2/1890 | Mooney | 33/646 |
| 652,256 | 6/1900 | Farmer | 33/646 |
| 4,937,950 | 7/1990 | Farnworth | 33/646 |

*Primary Examiner*—Harry N. Haroian
*Attorney, Agent, or Firm*—Lee A. Strimbeck

[57] ABSTRACT

The adjustable siding gauge described in these documents is to be used with any lap or clapboard siding application. By starting at the bottom with your first course level you can then adjust the gauge for the amount of clapboard you wish to show (or weather). By hooking the adjustable part (B) on the bottom edge of the first course and resting the body (A) up against the clapboard you can then simply place the next course on the wall and down until it rests on the top of the body, and then nail it.

By using the gauge in this way you will always have a consistent amount of weather between where the clapboards overlap, the courses will stay fairly level and there is no need to snap chalk lines to keep them even.

The adjustable siding gauge is easily carried and handled. It will last for years and it is fully adjustable from 1" to 8" of weather.

2 Claims, 1 Drawing Sheet

ADJUSTABLE SIDING GAUGE

FIELD OF INVENTION

This invention pertains to a tool useful in the construction of a house and more particularly is concerned with a gauge that assists in the application of lap or clapboard siding.

BACKGROUND OF THE INVENTION

In the application of clapboard siding, care must be taken to assure that each board is level and equally spaced along its length above the preceding board. Chalk lines can be used to do this but this can be time consuming and thus expensive.

SUMMARY OF THIS INVENTION

The present invention is addressed to this problem and proposes as a solution an adjustable gauge that can be used to uniformly set each course readily and effectively.

In brief compass, this invention is an adjustable siding gauge comprising:

an elongated bar, a parallelogram in cross section, and having one flat surface with a mortise end-to-end therein with the flat surface being ruled along the length of the mortise, the bottom of the mortise being slotted through the elongated bar with the slot terminating short of the ends of the mortise, and the upper end surface of the bar being tapered downwardly from the flat surface;

an adjustable block having a tenon mating with the mortise and slidable therein, the upper end of the block being beveled downwardly from the outer surface thereof, the block having a centrally disposed retaining means extending through the slot; and a clamping means on the end of the retaining means to secure the adjustable block to the elongated bar.

Preferably, the mortise and tenon are dovetailed, the retaining means is a bolt and the clamping means is a wing nut.

THE DRAWINGS

In the drawings.

In the drawings the same part has the same number throughout.

DESCRIPTION

Figure 1:
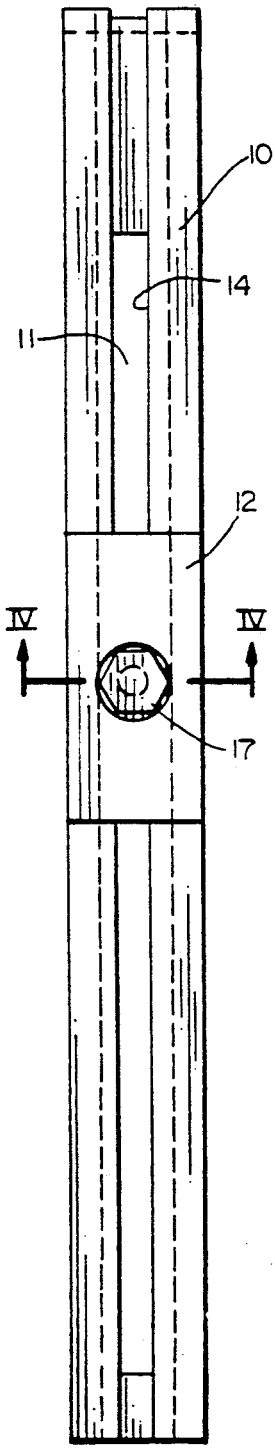
FIG. 1 is a front view of the gauge.
Figure 2:
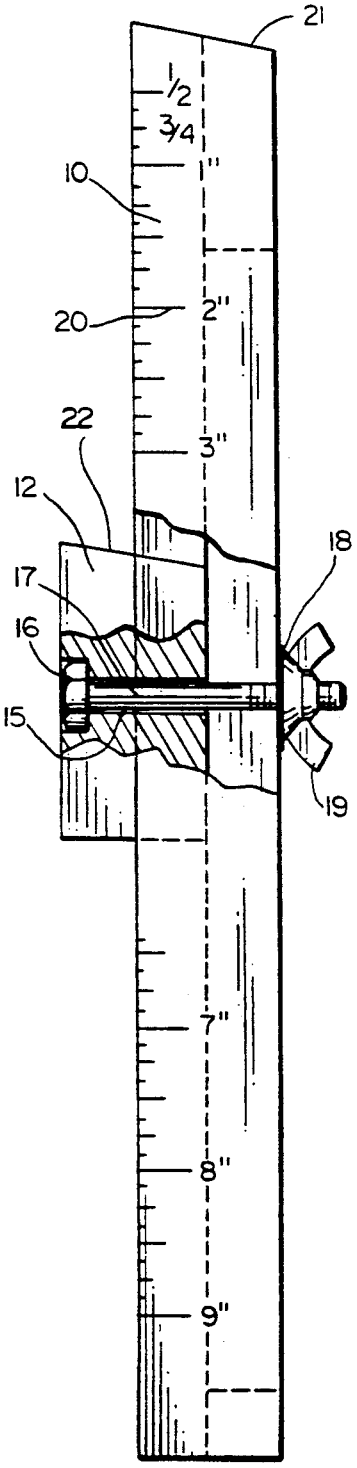
FIG. 2 is a side view.
Figure 3:
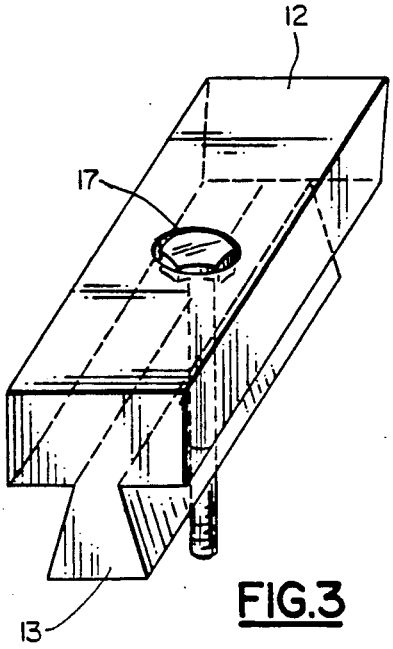
FIG. 3 is a perspective view of the block.
Figure 4:
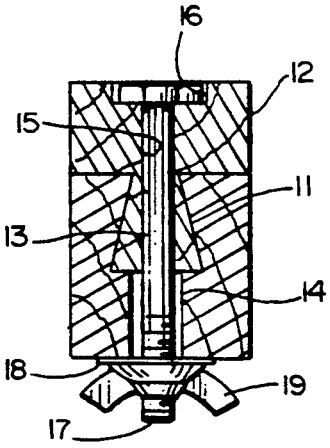
FIG. 4 is a cross sectional taken along the line of IV—IV of FIG. 1

The adjustable siding gauge is constructed by taking a ten inch piece of wood 10 one inch wide by one inch in depth and making a half inch dovetail groove 11 the full length down the center of the body 10. The block 12 is a two inch piece that has a dovetail tenon 13 the same width and depth the full length of the block. Block 12 can slide in groove 11 of body 10. Body 10 has a one quarter inch wide slot 14 connecting the back side of body 10 with groove 11. Slot 14 ends one half inch from the bottom and one and a half inches from the top. Block 12 has a one quarter inch centered hole 15. Hole 15 is countersunk at 16 to receive the head of a bolt 17.

To assemble, tenon 13 is inserted at one end of body 10, slid to an intermediate position and bolt 17 is inserted through hole 15. A washer 18 and wingnut 19 are then placed on bolt 17.

Body 10 is ruled the full length with a rule 20 in one eighth increments. By loosening wingnut 17 block 12 can be moved to a desired dimension. The top edge 21 of the body 10 and the top edge 22 of block 12 are preferably cut at a ten degree angle to better receive the beveled siding.

Even with the wingnut 19 removed the block 12 cannot fall off because unlike dovetail groove 11, the slot 14 through which the bolt 17 passes is not the full length of body 10. Block 12 therefore cannot be removed without taking bolt 17 out.

The adjustable siding gauge can be used with a lap or clapboard siding application. By starting at the bottom with the first course level, one can then adjust the gauge for the amount of clapboard you wish to show (or weather). By hooking the top surface 22 of adjustable block 12 on the bottom edge of the first course and resting body 10 up against the clapboard, one can then simply place the next course on the wall, bring it down until it rests on the top upper edge 21 of body 10 and then nail it.

By using the gauge in this way one will always have a consistent amount of weather between where the clapboards overlap. The courses will stay fairly level and there is no need to snap chalk lines to keep them even. The adjustable sliding gauge is easily carried and handled. The gauge of this invention is fully adjustable from 1 to 8 inches of weather.

I claim:

1. An adjustable siding gauge comprising, in combination:

a) an elongated bar, parallelogram in cross section and having one flat surface with a mortise end-to-end therein with said flat surface being ruled along the length of said mortise, the bottom of said mortise being slotted through said elongated bar with the slot terminating short of the ends of said mortise, and the upper end surface of said bar being tapered downwardly from said flat surface;

b) an adjustable block having a tenon mating with said mortise and slidable therein, the upper end of said block being beveled downwardly from the outer surface thereof, said block having a centrally disposed retaining means extending through said slot; and c) a clamping means on the end of said retaining means to secure said adjustable block to said elongated bar.

2. The adjustable siding gauge of claim 1 wherein said mortise and tenon are dovetailed, said retaining means is a bolt and said clamping means is a wing nut.

* * * * *